US011561042B2

(12) United States Patent
Felbab

(10) Patent No.: US 11,561,042 B2
(45) Date of Patent: Jan. 24, 2023

(54) METHOD OF COOLING BOIL-OFF GAS AND APPARATUS THEREFOR

(71) Applicant: LGE IP Management Company Limited, Dunfermline (GB)

(72) Inventor: Nikola Felbab, London (GB)

(73) Assignee: LGE IP Management Company Limited, Dunfermline (GB)

( * ) Notice: Subject to any disclaimer, the term of this patent is extended or adjusted under 35 U.S.C. 154(b) by 164 days.

(21) Appl. No.: 16/079,656

(22) PCT Filed: Feb. 27, 2017

(86) PCT No.: PCT/GB2017/050510

§ 371 (c)(1),
(2) Date: Aug. 24, 2018

(87) PCT Pub. No.: WO2017/144919

PCT Pub. Date: Aug. 31, 2017

(65) Prior Publication Data

US 2019/0072323 A1 Mar. 7, 2019

(30) Foreign Application Priority Data

| | | |
|---|---|---|
| Feb. 26, 2016 | (GB) | 1603403 |
| Mar. 15, 2016 | (GB) | 1604392 |
| Jun. 17, 2016 | (GB) | 1610641 |

(51) Int. Cl.
*F25J 1/00* (2006.01)
*F25J 1/02* (2006.01)

(52) U.S. Cl.
CPC ..... *F25J 1/0025* (2013.01); *F25J 1/0055* (2013.01); *F25J 1/0212* (2013.01); *F25J 1/0265* (2013.01);
(Continued)

(58) Field of Classification Search
CPC .. F25J 1/0025; F25J 1/00; F25J 1/0212; F25J 1/0225; F25J 1/0214; F25B 31/004;
(Continued)

(56) References Cited

U.S. PATENT DOCUMENTS 3,932,154 A 1/1976 Coers et al.
5,724,832 A * 3/1998 Little ..... F25J 1/0279 62/48.2

(Continued)

FOREIGN PATENT DOCUMENTS

CN 101573575 A 11/2009
CN 202675795 U 1/2013

(Continued)

OTHER PUBLICATIONS

Heat Transfer Equipment for LNG, IP.com No. IPCOM000182746D, Published May 9, 2009.

(Continued)

*Primary Examiner* — Frantz F Jules
*Assistant Examiner* — Webeshet Mengesha
(74) *Attorney, Agent, or Firm* — Flaster Greenberg PC

(57) ABSTRACT

The present invention is a modification of a typical single mixed refrigerant (SMR) cycle for LNG re-liquefaction in particular, that allows the use of a cost-efficient oil-injected screw compressor in the mixed refrigerant system. In comparison with the typical arrangement, the present innovation allows for reduced complexity, fewer pieces of equipment, and reduced capital cost. There is shown a method of cooling a boil-off gas (BOG) stream from a liquefied gas tank using a single mixed refrigerant (SMR) comprising at least the step of heat exchanging the BOG stream with the SMR in a liquefaction heat exchanger system to provide a cooled BOG stream, wherein the SMR is provided in an SMR recirculating system comprising at least the steps of: (a) compress-
(Continued)

ing the SMR using at least one oil-injected screw compressor to provide a post-compression SMR stream; (b) separating the post-compression SMR stream to provide an oil-based stream and a first SMR vapour stream; (c) passing the first SMR vapour stream into the liquefaction heat exchanger system to cool the first SMR vapour stream and provide a cooled first SMR vapour stream; (d) withdrawing the cooled first SMR vapour stream from the liquefaction heat exchanger system; (e) separating the cooled first SMR vapour stream to provide a liquid-phase SMR stream and an oil-free SMR vapour stream; (f) passing the oil-free SMR vapour stream through the liquefaction heat exchanger system to provide a condensed SMR stream; and (g) expanding the condensed SMR stream to provide an expanded lowest-temperature SMR stream to pass through the liquefaction heat exchanger system for heat exchange against the BOG stream.

20 Claims, 9 Drawing Sheets

(52) U.S. Cl.
CPC ..... *F25J 1/0277* (2013.01); *F25J 1/0279* (2013.01); *F25J 1/0291* (2013.01)

(58) Field of Classification Search
CPC ... F25B 9/00; B01D 3/42; F04B 37/00; F17C 1/00; F25D 3/00; F26B 3/16
See application file for complete search history.

(56) References Cited

U.S. PATENT DOCUMENTS

| | | | | |
|---|---|---|---|---|
| 6,350,240 | B1 | 2/2002 | Song et al. | |
| 6,530,240 | B1 * | 3/2003 | Kountz | F25B 1/047 62/611 |
| 6,553,772 | B1 | 4/2003 | Belanger et al. | |
| 7,165,422 | B2 | 1/2007 | Little | |
| 8,806,891 | B2 | 8/2014 | Brendeng et al. | |
| 9,945,604 | B2 | 4/2018 | Ott et al. | |
| 10,107,549 | B2 * | 10/2018 | Bonnissel | F25J 1/0296 |
| 10,422,558 | B2 * | 9/2019 | Shimazu | F25B 43/02 |
| 10,655,911 | B2 * | 5/2020 | Turner | F25J 1/0208 |
| 2010/0058802 | A1 * | 3/2010 | Brendeng | F25J 1/0265 62/612 |
| 2010/0139316 | A1 | 6/2010 | An et al. | |
| 2010/0293996 | A1 | 11/2010 | Van Aken et al. | |
| 2011/0219819 | A1 * | 9/2011 | Bauer | F25J 1/0055 62/612 |
| 2014/0260415 | A1 * | 9/2014 | Ducote, Jr. | F25J 1/0212 165/104.21 |
| 2015/0338161 | A1 * | 11/2015 | Park | F25J 1/0055 62/611 |

FOREIGN PATENT DOCUMENTS

| | | | |
|---|---|---|---|
| CN | 204678802 | U | 9/2015 |
| CN | 204718299 | U | 10/2015 |
| EP | 1092933 | A1 | 4/2001 |
| EP | 1059494 | | 5/2006 |
| EP | 1959217 | A2 | 8/2008 |
| EP | 2944902 | A2 | 11/2015 |
| GB | 1323831 | | 7/1973 |
| JP | H08-159652 | | 6/1996 |
| JP | H2008-519242 | | 6/2008 |

OTHER PUBLICATIONS

GB Search report for corresponding application No. GB1603403.5, dated Aug. 31, 2016.
ISR for corresponding PCT/GB2017/050510, dated May 23, 2017.
Chinese office action (and English translation) for corresponding CN application No. 201780013219.7, dated Dec. 27, 2019.
Onboard Reliquification of LNG Boil-Off, 979 Trans. of Inst. of Marine Eng., vol. 02 (Jan. 1, 1980) No. 2, London, K. Witt (XP-001277355).
World Scale Boil-Off Gas Reliquefaction, AICHE Spring National Meeting, Apr. 30, 2013, H. Bouer, et al. (XP-009195010).
Small Scale Natural Gas Liquification Plants, P. Neska et al., XP-001543121, Int'l Congress of Refrigeration 2007 (Beijing).
ISR and Written Opinion for PCT/GB2018/051012, dated Jul. 4, 2018.
ISR and Written Opinion for PCT/GB2020/052017, dated Nov. 9, 2020.
P. Neska, et al.; Development And Analysis Of A Natural Gas Reliquefaction Plant For Small Gas Carriers; Journal of Natural Gas Science 2, 2010, 143-149 (Jun. 4, 2010).
KR Application No. 10-2019-7034017; Office Action dated Sep. 8, 2022 (English translation).

* cited by examiner

METHOD OF COOLING BOIL-OFF GAS AND APPARATUS THEREFOR

The present invention relates to a method of cooling a boil-off gas (BOG) stream from a liquefied gas tank, such as a cargo tank, such as on a floating vessel, using a single mixed refrigerant (SMR), and apparatus therefor. It is particularly, but not exclusively, a method for cooling BOG from a floating LNG storage tank.

Traditionally, boil-off gas from liquefied natural gas (LNG) storage tanks on board ships carrying LNG as a cargo (typically LNG carriers) has been used in the ship engines to provide power to the ship. Any excess BOG is then considered 'waste gas', and is typically sent to a gas combustion unit (GCU), where it is disposed of by combustion.

However, ship engines have become increasingly more efficient, so that less of the BOG is required for the engines. This means a greater proportion of the BOG is sent to the GCU as waste gas. It is becoming economically attractive to reduce this loss of gas by re-liquefying it and returning it to the cargo tanks.

A standard method of re-liquefying LNG BOG uses a single mixed refrigerant (SMR) cycle, and an oil-injected screw compressor in the mixed refrigerant recirculating system. Oil-injected screw compressors are well proven in industry and cost-effective such that their use is preferred where possible. However, oil-injected screw compressors also have a certain degree of oil 'carryover' into the SMR during the compression, and exposure of the carryover oil to the lowest temperatures required in the LNG heat exchanger will solidify the oil and block up the LNG exchanger, leading to reduced performance, and ultimately system failure.

As such, the post-compression SMR must undergo at least one oil/gas separation step and at least one significant cooling step leading to partial condensation of the SMR to provide a sufficiently 'oil-free' stream that can be expanded to a temperature that is below the 'oil-solidification' temperature, before use as the main cooling stream.

A conventional SMR cycle with an oil-injected screw compressor is shown in the accompanying FIG. 1. Boil-off gas from cargo tanks is compressed in a compressor (not shown) and sent for cooling via pipeline 20. The compressed boil-off gas is first cooled in an aftercooler 14 using a readily available ambient cooling medium (e.g. seawater, freshwater, engine room cooling water, air), after which it is cooled further in heat exchanger 12. This pre-cooled BOG is sent into multi-stream (i.e. more than just two streams) heat exchanger 7 (typically a brazed aluminium plate-fin heat exchanger), where it is cooled and condensed using an SMR recirculating system.

The heat exchanger 12 uses an external refrigerant (typically propane) supplied via pipeline 32, provided from a separate refrigerant cascade 13.

In the SMR recirculating system, the mixed refrigerant gas from refrigerant receiver 1 flows through a pipeline 22 to an oil-injected screw compressor 2. The SMR gas is compressed into pipeline 23, after which it enters an oil separator 3, where most of the oil is removed (by gravity and/or filtration) and sent into pipeline 25 to be pumped by oil pump 4, cooled by oil cooler 5, and finally re-injected into compressor 2.

The gas from oil separator 3 is sent into pipeline 24. The gas in this pipeline is mostly oil-free, but does contain a small proportion (down to parts per million by weight) of oil. The gas in pipeline 24 is sent into an aftercooler 6 which uses a readily available cooling medium (e.g. seawater, freshwater, engine room cooling water, air).

Downstream of the aftercooler 6, condensation of the refrigerant gas is performed using heat exchange against a cold external refrigerant (typically propane) in condenser 11. The cold temperatures of this external refrigerant are created in the external refrigerant cascade 13. The refrigerant in pipeline 24 is at least partly condensed after passing through condenser 11, after which it enters a vapour-liquid separator 8 to provide vapour and liquid phases. A significant feature of the condensation in the condenser 11 and the separation (generally by gravity and optionally filtration), in a separator 8 (optionally having an integral or separate filter), is that the oil carried over after the separator 3 is now effectively all in the liquid phase, going into pipeline 29, leaving an essentially oil-free vapour in pipeline 26.

The refrigerant liquid with oil in pipeline 29 has its pressure reduced by flash valve 9, leading to partial vaporisation and temperature reduction. This temperature is not low enough to cause solidification (waxing or freezing) of the oil. The partially vaporised refrigerant liquid and oil can then be sent into a multi-stream exchanger 7, where it is fully vaporised, thereby providing partial cooling to the hot streams in the exchanger 7. Meanwhile, the oil-free refrigerant vapour in pipeline 26 is sent directly into exchanger 7, where it is cooled substantially. It leaves the exchanger 7, fully or partly condensed, in pipeline 27, after which its pressure is reduced by a throttling valve 10 into pipeline 34 to its lowest temperature in the SMR recirculating system to achieve the required cooling in the exchanger 7. This provides the main cold stream for the exchanger 7. It is because the temperature of the refrigerant in pipeline 34 will be below the solidification temperature of the oil that it is necessary to remove the oil using exchanger 11 and separator 8 prior to pipeline 27.

The cold refrigerant in pipeline 34 is sent into exchanger 7, where it vaporises, cooling the hot streams. It merges with the depressurised liquid and oil sent from valve 9, and the combined refrigerant stream leaves exchanger 7 as a vapour via pipeline 28, to re-enter refrigerant receiver 1.

Overall, the cooling duty for the re-liquefaction process in the conventional SMR cycle shown in FIG. 1 is provided by both the SMR recirculating system and the external refrigerant cascade 13.

It is an object to the present invention to provide a simpler method, process and apparatus for cooling a BOG stream without an external refrigerant cascade.

Thus, according to the first aspect of the present invention, there is provided a method of cooling a boil-off gas (BOG) stream from a liquefied gas tank using a single mixed refrigerant (SMR) comprising at least the step of heat exchanging the BOG stream with the SMR in a liquefaction heat exchanger system to provide a cooled BOG stream, wherein the SMR is provided in an SMR recirculating system comprising at least the steps of:

(a) compressing the SMR using at least one oil-injected screw compressor to provide a post-compression SMR stream;

(b) separating the post-compression SMR stream to provide an oil-based stream and a first SMR vapour stream;

(c) passing the first SMR vapour stream into the liquefaction heat exchanger system to cool the first SMR vapour stream and provide a cooled first SMR vapour stream;

(d) withdrawing the cooled first SMR vapour stream from the liquefaction heat exchanger system;

(e) separating the cooled first SMR vapour stream to provide a liquid-phase SMR stream and an oil-free SMR vapour stream;

(f) passing the oil-free SMR vapour stream through the liquefaction heat exchanger system to provide a condensed SMR stream; and (g) expanding the condensed SMR stream to provide an expanded lowest-temperature SMR stream to pass through the liquefaction heat exchanger system for heat exchange against the BOG stream.

SMR is a term in the art used to refer to a range of refrigerants generally comprising a mixture of one or more hydrocarbons, in particular usually methane, ethane and propane, and possibly also at least butane, and nitrogen, optionally with one or more other possible refrigerants such as pentane. Various components and their ratios are known for forming a particular SMR, and are not further described herein.

The "oil-based stream" comprises the large majority of the oil in the SMR stream that has passed through the oil-injected screw compressor. The remaining amount of oil in the first SMR vapour stream may be small, optionally extremely small, but is still significant as discussed above.

Separating one or more of the streams as defined herein can be carried out in any suitable separator, many of which are known in the art, and which are generally intended to provide at least one gaseous stream, typically a lighter stream available at or near an upper part of the separator, and a heavier stream, typically comprising at least one liquid phase, typically available at a lower end of the separator.

Expansion of a stream is possible through one or more suitable expansion devices, generally including valves and the like.

The term "ambient cooling" as used herein relates to the use of an ambient cooling medium, usually provided at an ambient temperature. This includes seawater, freshwater, engine room cooling water, and air, and any combination thereof, which are typically easily available for use in providing ambient cooling to a stream.

Optionally, the first SMR vapour stream and/or the oil-free SMR vapour stream are cooled against the expanded lowest-temperature SMR stream.

All liquefied gas tanks create or release boil-off gas for known reasons, including tanks on liquefied gas carriers, barges and other vessels including transportation vessels. Liquefied gases can include those having normal boiling points (at 1 atm) below 0° C., typically at least below −40° C., such as various petroleum or petrochemical gases, and including liquefied natural gas (LNG) having a normal boiling point below −160° C.

Whilst BOG from liquefied gas tanks may be more readily useable onshore, it is especially desired to seek re-liquefaction of BOG offshore. However, space is typically limited offshore, especially on floating vessels, and the ability to reduce the complexity of BOG re-liquefaction can often achieve a reduction in the required CAPEX and plot area required.

Optionally, the BOG is from a liquefied cargo tank in a floating vessel, optionally an LNG cargo tank.

It is possible that the compression of the SMR in step (a) comprises the use of more than one compressor, optionally in parallel or series or both, to provide the post-compression SMR stream. The invention is not limited by the method or type of compression of the SMR, other than the use of at least one oil-injected screw compressor.

The liquefaction heat exchanger system may be any form of one or more heat exchangers arranged in one or more units or stages, and able to allow heat exchange between two or more streams, and optionally having at least one stream running countercurrently to one or more other streams in a part or portion of the system, in particular between the BOG stream and one of the refrigerant streams.

Where the liquefaction heat exchanger system comprises more than one heat exchanger, the more than one heat exchangers may be in series or in parallel or a combination of in series and in parallel, and the more than one heat exchangers may be separate or conjoined or contiguous, optionally in a single cooled unit or box, and optionally in the form of one or more units or stages of providing the required heat exchange with the BOG stream to liquefy the BOG stream.

The liquefaction heat exchanger system may comprise any suitable arrangement of two-stream or multi-stream heat exchangers arranged into one or more connected sections, units or stages, optionally with one section, unit or stage being 'warmer' than another section, unit or stage, in the sense of the average temperature therein.

Many liquefaction heat exchangers are known in the art which are able to be part of or provide the liquefaction heat exchanger system, typically comprising plate-fin, shell & tube, plate & frame, shell & plate, coil wound, and printed circuit heat exchangers, or any combination thereof.

Optionally, the liquefaction heat exchanger system comprises a multi-unit liquefaction heat exchange comprising two multi-stream heat exchangers.

Alternatively, the liquefaction heat exchanger system comprises a multi-unit liquefaction heat exchange comprising one multi-stream heat exchanger and a plurality of two-stream heat exchangers.

Optionally, the liquefaction heat exchanger system in the present invention comprises one or more plate-fin heat exchangers.

Optionally, the liquefaction heat exchanger system in the present invention comprises a combination of one or more plate-fin heat exchangers and one or more two-stream plate-type (plate & frame or shell & plate) heat exchangers.

Heat exchangers generally have one or more entry points or ports for each stream, and one or more exit points or ports for said stream, with a temperature gradient or gradient pathway thereinbetween. Most streams passing through a heat exchanger pass typically through 'all' the heat exchanger, that is from an entry point or port at one end or side of the heat exchanger to an exit point or port, optionally at an other end or side but not limited thereto, so as to achieve the maximum heat exchange possible between the entry and exit, i.e. the maximum temperature change or phase change possible along the temperature gradient pathway. Such streams have 'fully' or 'wholly' passed through the heat exchanger.

Some streams may only pass through a partial portion or amount of a heat exchanger, generally by either having an entry point or port at an intermediate temperature or location along the maximum possible temperature gradient pathway, or by having an exit point or port at an intermediate temperature along the temperature gradient pathway, or both. Such streams have passed through only part of the heat exchanger.

In the present invention, the liquefaction heat exchange can be provided in a single stage or in a multi-stage arrangement, optionally in line with the number of liquefaction heat exchangers in the liquefaction heat exchanger system, but not limited thereto where more than one heat exchange stage can be provided with a single liquefaction heat exchanger.

Optionally, the liquefaction heat exchanger system is a single liquefaction heat exchanger. In one further option, the method comprises passing the oil-free SMR vapour stream partly through the single liquefaction heat exchanger prior to step (g), i.e. passing the oil-free SMR vapour stream into the single liquefaction heat exchanger at an intermediate temperature along the heat exchange.

In another further option, the method comprises passing the oil-free SMR vapour stream fully through the single liquefaction heat exchanger prior to step (g).

Optionally, where the liquefaction heat exchanger system is a single liquefaction heat exchanger, withdrawal of the cooled first SMR vapour stream from the liquefaction heat exchanger system in step (d) can occur at an intermediate temperature along the heat exchange occurring in the heat exchanger, optionally at a temperature that is similar to the entry for the oil-free SMR vapour stream into the liquefaction heat exchanger system to provide a condensed SMR stream.

Thus, optionally, step (d) of the present invention comprises withdrawing the cooled first SMR vapour stream from the liquefaction heat exchanger system prior to the coolest part of the liquefaction heat exchanger system, i.e. achieving partial passageway through the liquefaction heat exchanger system.

The oil-free SMR vapour stream may be passed (back) into the liquefaction heat exchanger system at a temperature that is higher than, lower than, the same as, or similar to, the temperature of the withdrawn cooled first SMR vapour stream of step (d).

Optionally, the oil-free SMR vapour stream passes into the liquefaction heat exchanger system at a temperature that is similar to the temperature of the withdrawn cooled first SMR vapour stream of step (d).

Alternatively, the liquefaction heat exchanger system may be a multi-unit liquefaction heat exchange or exchanger comprising two, optionally more than two, units, and the expanded lowest-temperature SMR stream passes through each unit.

Where the liquefaction heat exchange is provided by more than one liquefaction heat exchanger units and/or stages, optionally the first SMR vapour stream passes into a first unit and/or stage, and the oil-free SMR vapour stream passes into a second unit and/or stage. Alternatively optionally, the first SMR vapour stream passes into a first heat exchange unit, and the oil-free SMR vapour stream passes into both a first heat exchange unit and a second heat exchanger unit.

Where the liquefaction heat exchange is provided by more than one liquefaction heat exchanger units and/or stages, also optionally the first or warmer stage comprises either a multi-stream heat exchanger such as a plate-fin heat exchanger, or a series of distinct heat exchangers, optionally in series, in parallel, or both, at least one of which is able to cool the first SMR vapour stream and provide a cooled first SMR vapour stream prior to separating the cooled first SMR vapour stream to provide a liquid-phase SMR stream and an oil-free SMR vapour stream.

Optionally, the method of the present invention further comprises the steps of expanding the liquid-phase SMR stream of step (e), and passing the expanded liquid-phase SMR stream into the liquefaction heat exchanger system.

Optionally, the method of the present invention further comprises the step of combining the expanded liquid-phase SMR stream with the expanded lowest-temperature SMR stream in the liquefaction heat exchanger system, further optionally, between two stages or units of a multi-stage or multi-unit liquefaction heat exchanger system.

Optionally, the method of the present invention alternatively further comprises the step of combining the expanded liquid-phase SMR stream with the expanded lowest-temperature SMR stream after the liquefaction heat exchanger system.

The method of the present invention provides a post-liquefaction heat exchange SMR stream, or a post-cooling vapour SMR stream, for recirculation or reuse as part of the SMR recirculating system. This post stream is optionally the expanded liquid-phase SMR stream combined with the expanded lowest-temperature SMR stream, being combined either within or after the liquefaction heat exchanger system.

Thus, optionally, the method of the present invention further comprises recycling the expanded lowest-temperature SMR stream after the liquefaction heat exchanger for providing the SMR, typically with the additional expanded liquid-phase SMR stream.

Optionally, the condensed SMR stream is expanded to provide an expanded lowest-temperature SMR stream having a temperature below the oil-solidification temperature of the oil in the at least one oil-injected screw compressor compressing the SMR.

In the present invention, it is intended that the first SMR vapour stream of step (b) does not undergo any external refrigerant cooling prior to step (e), such that an external refrigerant cascade is not required. The SMR liquefaction heat exchanger system itself wholly or substantially provides the refrigerant cooling required to condense the oil-free SMR vapour stream prior to its expansion back into the liquefaction heat exchanger system.

Optionally, the BOG stream also does not undergo any external refrigerant cooling prior to passing through the liquefaction heat exchanger.

In this way, the expanded lowest-temperature SMR stream provides the cooling of the first SMR vapour stream, and preferably, the expanded lowest-temperature SMR stream provides all the sub-ambient refrigerant cooling duty for cooling the BOG stream and in the SMR recirculating system.

According to another aspect of the present invention, there is provided an SMR recirculating system for use with a method of cooling a boil-off gas (BOG) stream from a liquefied gas tank using a single mixed refrigerant (SMR) comprising at least the step of heat exchanging the BOG stream with the SMR in a liquefaction heat exchanger system to provide a cooled BOG stream, wherein the SMR is provided in an SMR recirculating system comprising at least the steps of:

(a) compressing the SMR using at least one oil-injected screw compressor to provide a post-compression SMR stream;

(b) separating the post-compression SMR stream to provide an oil-based stream and a first SMR vapour stream;

(c) passing the first SMR vapour stream into the liquefaction heat exchanger system to cool the first SMR vapour stream and provide a cooled first SMR vapour stream;

(d) withdrawing the cooled first SMR vapour stream from the liquefaction heat exchanger system;

(e) separating the cooled first SMR vapour stream to provide a liquid-phase SMR stream and an oil-free SMR vapour stream;

(f) passing the oil-free SMR vapour stream through the liquefaction heat exchanger system to provide a condensed SMR stream; and (g) expanding the condensed SMR stream to provide an expanded lowest-temperature SMR stream to pass through the liquefaction heat exchanger system for heat exchange against the BOG stream.

Optionally, the SMR recirculating system is for use in cooling BOG from a liquefied cargo tank in a floating vessel, optionally an LNG cargo tank.

Optionally, the SMR recirculating system is for use with a liquefaction heat exchanger system as defined herein.

Optionally, the SMR recirculating system further comprises one or more further steps as herein described in relation to the method of cooling a BOG stream.

It is intended that the SMR recirculating system of the present invention is able to provide all the sub-ambient refrigerant cooling duty for cooling a boil-off gas stream from a liquefied gas tank and in the SMR recirculating system.

According to another aspect of the present invention, there is provided an apparatus for cooling a boil-off gas (BOG) stream from a liquefied gas tank comprising a single mixed refrigerant (SMR) recirculating system as defined herein and a liquefaction heat exchanger for heat exchange against the BOG stream.

According to a further aspect of the invention, there is provided a method of integratively designing a vessel having a method of cooling a boil-off gas (BOG) stream from a liquefied gas tank using a single mixed refrigerant (SMR) comprising at least the step of heat exchanging the BOG stream with the SMR in a liquefaction heat exchanger system to provide a cooled BOG stream, comprising the step of selecting an SMR recirculating system comprising at least the steps of:

wherein the SMR is provided in an SMR recirculating system comprising at least the steps of:

(a) compressing the SMR using at least one oil-injected screw compressor to provide a post-compression SMR stream;

(b) separating the post-compression SMR stream to provide an oil-based stream and a first SMR vapour stream;

(c) passing the first SMR vapour stream into the liquefaction heat exchanger system to cool the first SMR vapour stream and provide a cooled first SMR vapour stream;

(d) withdrawing the cooled first SMR vapour stream from the liquefaction heat exchanger system;

(e) separating the cooled first SMR vapour stream to provide a liquid-phase SMR stream and an oil-free SMR vapour stream;

(f) passing the oil-free SMR vapour stream through the liquefaction heat exchanger system to provide a condensed SMR stream; and (g) expanding the condensed SMR stream to provide an expanded lowest-temperature SMR stream to pass through the liquefaction heat exchanger system for heat exchange against the BOG stream.

According to a further aspect of the invention, there is provided a method of integratively designing an SMR recirculating system for use with a method of cooling a boil-off gas (BOG) stream from a liquefied gas tank comprising the same or similar steps as described herein.

According to a still further aspect of the invention, there is provided a method of designing a process for cooling a boil-off gas (BOG) stream from a liquefied gas tank using a single mixed refrigerant (SMR) comprising the same or similar steps as described herein.

According to a still further aspect of the invention, there is provided a method of designing an SMR recirculating system for use with a method of cooling a boil-off gas (BOG) stream from a liquefied gas tank comprising the same or similar steps as described herein.

The designing methods as discussed herein may incorporate computer aided processes for incorporating the relevant operational equipment and controls into the overall vessel construction and may incorporate relevant cost, capacity of operation parameters into the methodology and design. The methods described herein may be encoded onto media that is suitable for being read and processed on a computer.

For example, code to carry out the methods described herein may be encoded onto a magnetic or optical media which can be read by and copied to a personal or mainframe computer. The methods may then be carried out by a design engineer using such a personal or mainframe computer.

Embodiments and an example of the present invention will now be described by way of example only and with reference to the accompanying schematic drawings in which.

Figure 8:
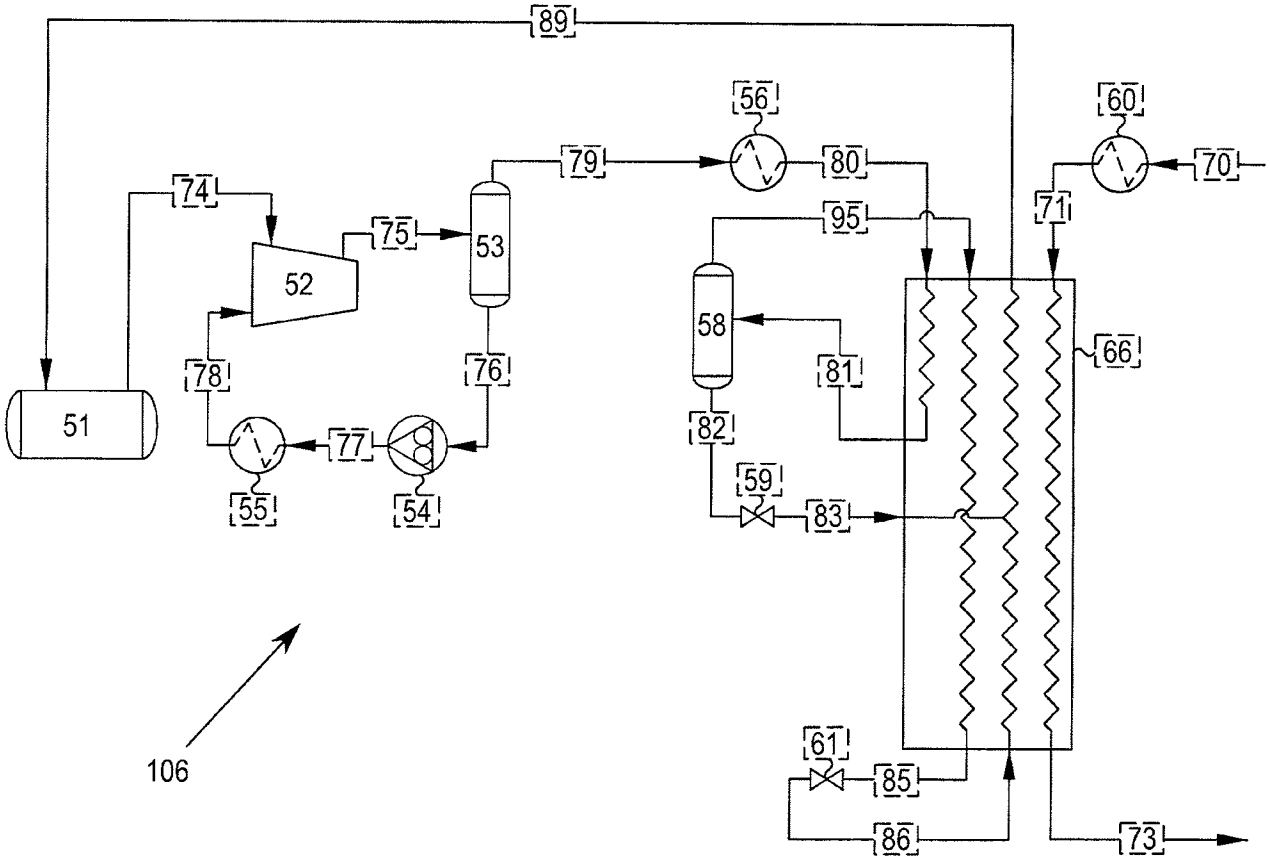
Figure 9:
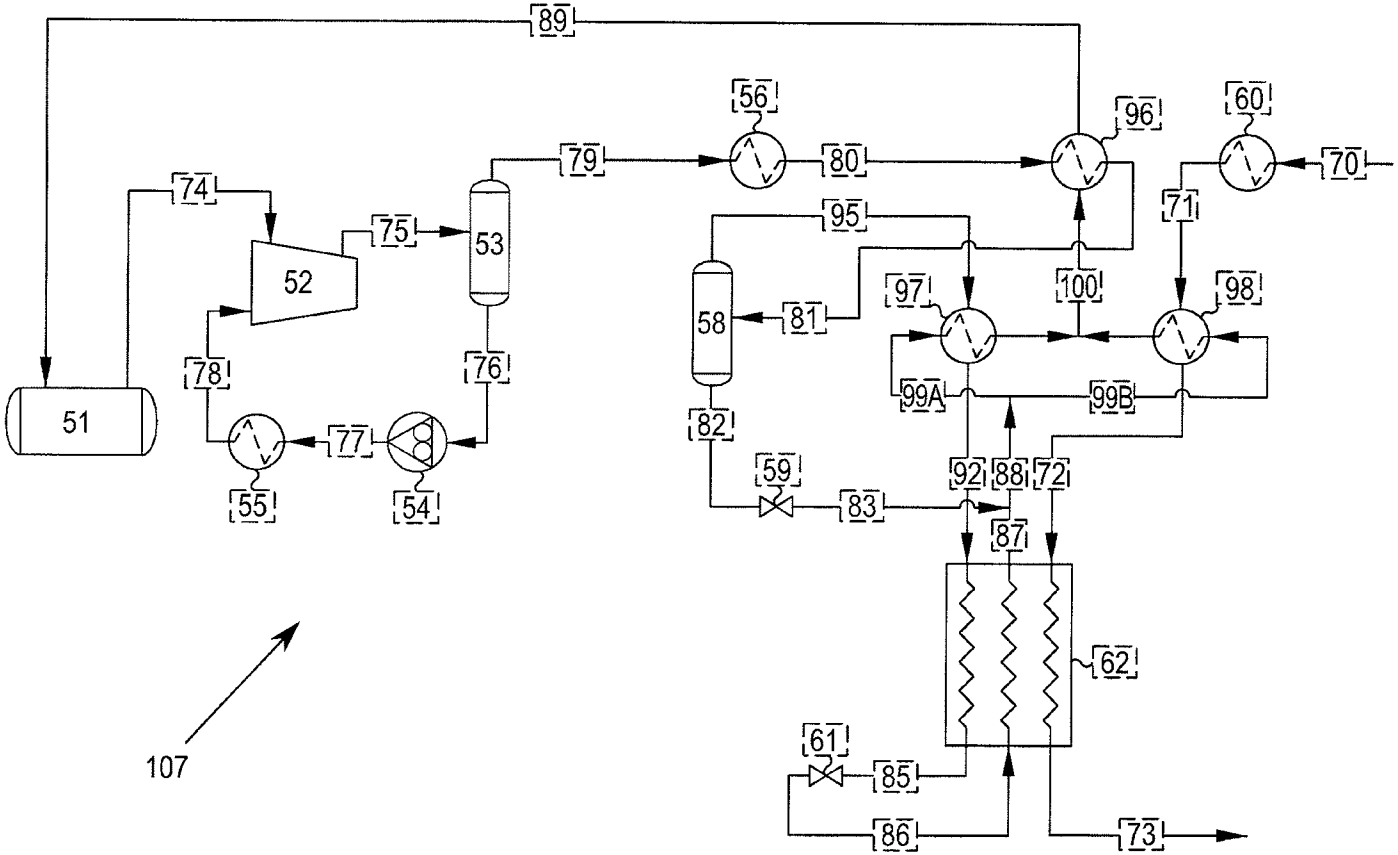

FIG. 8 is a schematic view of a method of cooling a BOG stream using an SMR system according to a sixth embodiment of the present invention; and FIG. 9 is a schematic view of a method of cooling a BOG stream using an SMR system according to a seventh embodiment of the present invention Where relevant, the same reference numerals are used in different Figures to represent the same or similar feature.

Figure 1:
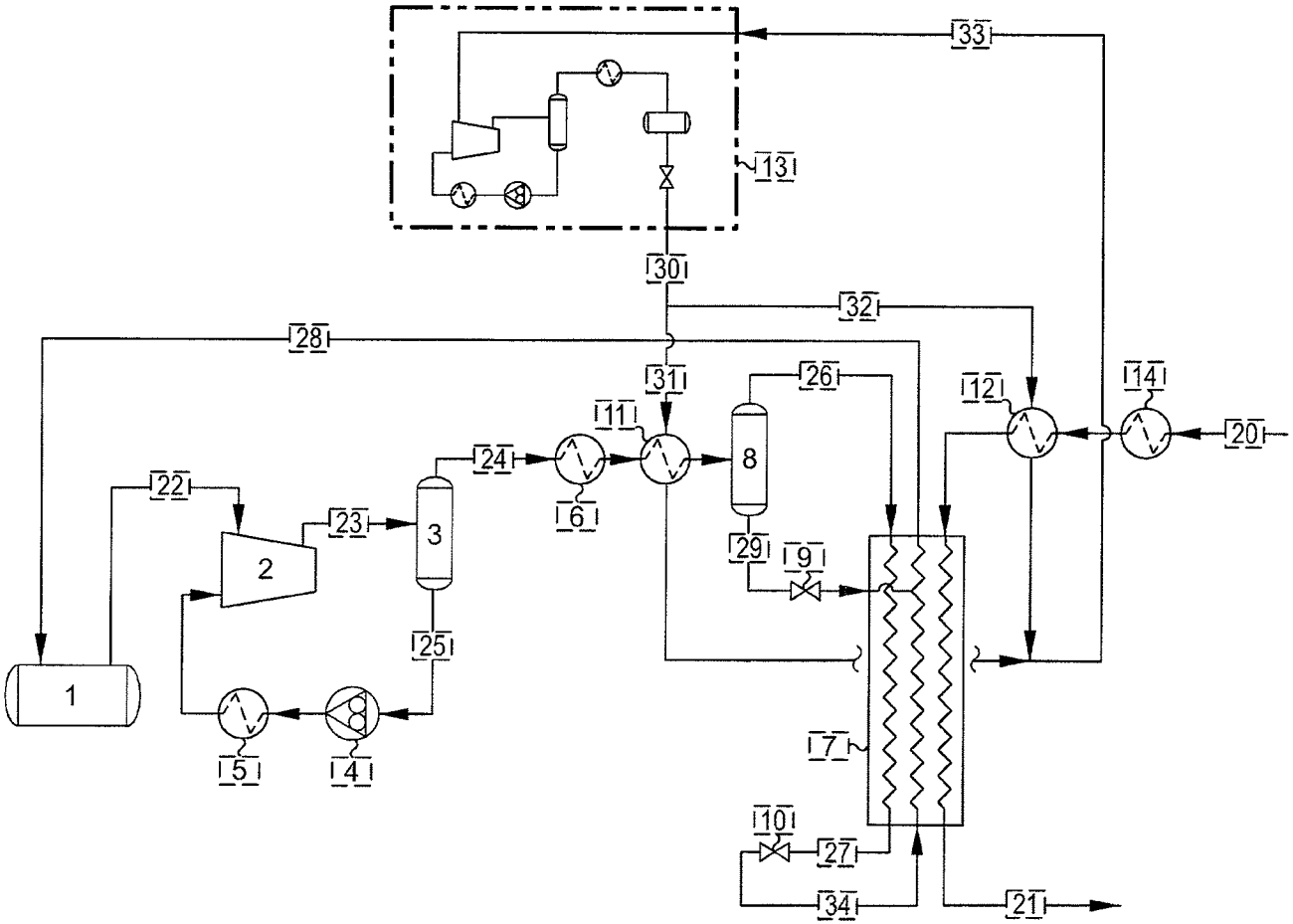
FIG. 1 is a schematic view of a prior art method of cooling a BOG stream using a prior art SMR system.

FIG. 1 is a prior art arrangement described hereinabove, which requires an external refrigerant circuit and apparatus based on cascade 13 to achieve reliquefaction of the compressed BOG using an SMR recirculating system and an oil-injected screw compressor 2.

Figure 2:
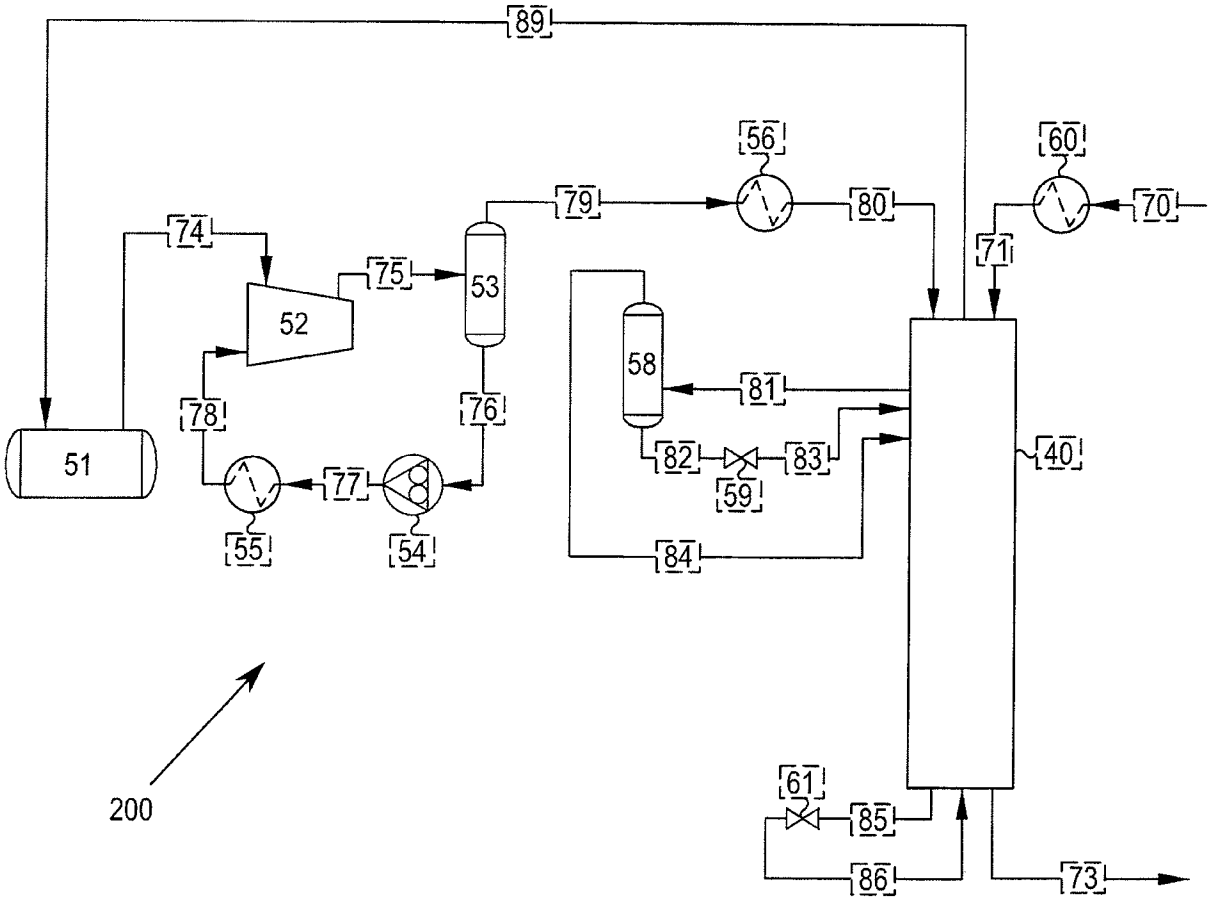
FIG. 2 is a schematic view of a method of cooling a BOG stream using an SMR system according to a general embodiment of the present invention.

FIG. 2 shows a method of cooling a boil-off gas stream from a liquefied gas tank according to a general embodiment of the present invention, using a single mixed refrigerant (SMR), and comprising at least the step of heat exchanging the BOG stream with the SMR in a liquefaction heat exchanger system to provide a cooled BOG stream, and wherein the SMR is provided in an SMR recirculating system according to another embodiment of the present invention.

In more detail, FIG. 2 shows a BOG stream 70 provided from one or more LNG cargo tanks (not shown) and already compressed in a compressor (also not shown).

The BOG stream 70 is optionally ambient cooled in a first ambient heat exchanger 60, using a readily available cooling medium (e.g. seawater, freshwater, engine room cooling water, air). This optionally cooled (and compressed) BOG stream 71 is then passed into a liquefaction heat exchanger system 40.

The liquefaction heat exchanger system 40 may comprise any form or arrangement of one or more heat exchangers able to allow heat exchange between two or more streams, optionally between multiple streams, and optionally having at least one stream running counter currently to one or more other streams in a part or portion of the system, in particular between the BOG stream and one of the refrigerant. Any arrangement of more than one heat exchanger may be in series or in parallel or a combination of in series and in parallel, and the heat exchangers may be separate or conjoined or contiguous, optionally in a single cooled unit or box, and optionally in the form of one or more stages of providing the required heat exchange with the BOG stream to liquefy the BOG stream.

Liquefaction heat exchanger systems comprising more than one heat exchanger generally have a one section, unit or stage being 'warmer' than another section, unit or stage, in the sense of the average temperature therein.

Some variants of suitable liquefaction heat exchanger systems are discussed and shown hereinafter. The skilled man can recognise other variants, and the invention is not limited thereby.

In the general liquefaction heat exchanger system 40 shown in FIG. 2, the cooled (and compressed) BOG stream 71 is condensed by colder streams discussed hereinafter, generated in the SMR recirculating system 200. The condensed BOG stream leaves the exchanger system 40 via pipeline 73, and can be returned back to the LNG cargo tanks.

In the SMR system 200, an initial stream of SMR refrigerant gas 74 from a refrigerant receiver 51 is sent to an oil-injected screw compressor 52. Oil-injected screw compressors are well known in the art, and not further described herein. Oil-injected screw compressors are well proven in industry and are cost effective, especially for small scale or small volume compression, but are known to have the disadvantage that some, possibly even microscopic amounts, of the oil can become entrained in the gas passing through the compressor, and thus become a part of the gas discharge therefrom.

In FIG. 2, compressing the initial SMR stream 74 using the one oil-injected screw compressor 52 provides a post-compression SMR stream 75, which enters a first oil separator 53, optionally having a filter, which separates the post-compression SMR stream 75 to provide an oil-based stream 76 and a first SMR vapour stream 79. Most of the oil is removed in the separator 53 typically by gravity and/or filtration. The recovered oil-based stream 76 is drained into a pipeline where pressure differences or an optional oil pump 54 passes the oil to stream 77, and an oil cooler 55 cools the oil, which is then re-injected as stream 78 into compressor 52.

The first SMR vapour stream 79 is mostly oil-free, but does contain some degree of oil carryover. The first SMR vapour stream 79 is cooled in a second ambient heat exchanger 56 using a readily available cooling medium (e.g. seawater, freshwater, engine room cooling water, air) to provide a cooler first vapour stream 80. Depending on the composition and pressure of the refrigerant, as well as on the temperature achieved in the second ambient heat exchanger 56, some condensation of the SMR may start to occur.

The cooler first vapour stream 80 passes into the liquefaction heat exchanger system 40, where the refrigerant is cooled and at least partially condensed. The temperature to which it is cooled is higher than the solidification temperature of the oil. The cooled first SMR vapour stream 81 is withdrawn from an intermediate temperature along the liquefaction heat exchanger system 40, and enters a vapour-liquid separator 58. In the separator 58, a liquid-phase SMR stream 82, generally comprising liquid and any residual oil amount, can be drained via pipeline 82.

Thereafter, the pressure of the liquid-phase SMR stream 82 can be reduced by a flash valve 59, resulting in some vaporisation and an associated reduction in temperature. The SMR system 200 is designed such that this lower temperature is still above the solidification temperature of the oil. The expanded, or at least partly vaporised, liquid-phase SMR stream 83 can be sent into the heat exchanger system 40, where it provides some cooling to warmer streams, while itself being vaporised.

In the separator 58, an oil-free (or essentially oil-free) SMR vapour stream 84 is also sent into the heat exchanger system 40. In FIG. 2, the oil-free SMR vapour stream 84 enters the heat exchanger system 40 at an intermediate temperature, optionally at a similar temperature to that at the withdrawal of the cooled first SMR vapour stream 81. In the heat exchanger system 40, this oil-free SMR vapour stream 84 is cooled until it partly or wholly condenses, leaving the heat exchanger system 40 as a condensed SMR stream 85. Thereafter, the pressure is reduced via throttling valve 61, leading to partial vaporisation and temperature reduction to provide the expanded lowest-temperature SMR stream 86. The expanded lowest-temperature SMR stream 86 is the coolest SMR refrigerant stream in the SMR system 200, having a temperature below the oil-solidification temperature of the oil in the oil-injected screw compressor 52.

The expanded lowest-temperature SMR stream 86 is sent back into heat exchanger system 40, where it vaporises as it heats up, and in doing so, cools the warmer streams in the heat exchanger system 40 to provide the majority of the cooling duty. The SMR refrigerant stream 86 can merge with the expanded liquid-phase SMR stream 83 to form a single stream which leaves the heat exchanger system 40 as a post-cooling vapour stream 89, to be returned to refrigerant receiver 51.

In this way, the requirement in prior art arrangement in FIG. 1 for an external refrigerant cascade is removed, such that the condensation of mixed refrigerant at a temperature above oil solidification takes place by cooling within the liquefaction heat exchanger system. This represents a reduction in capital expenditure, and in overall plant size. The partial condensation necessary to remove compressor oil from the portion of refrigerant gas exposed to the lowest temperatures in the system is achieved without an external refrigerant cascade loop, having shifted that duty to the SMR recirculating system only.

Figure 3:
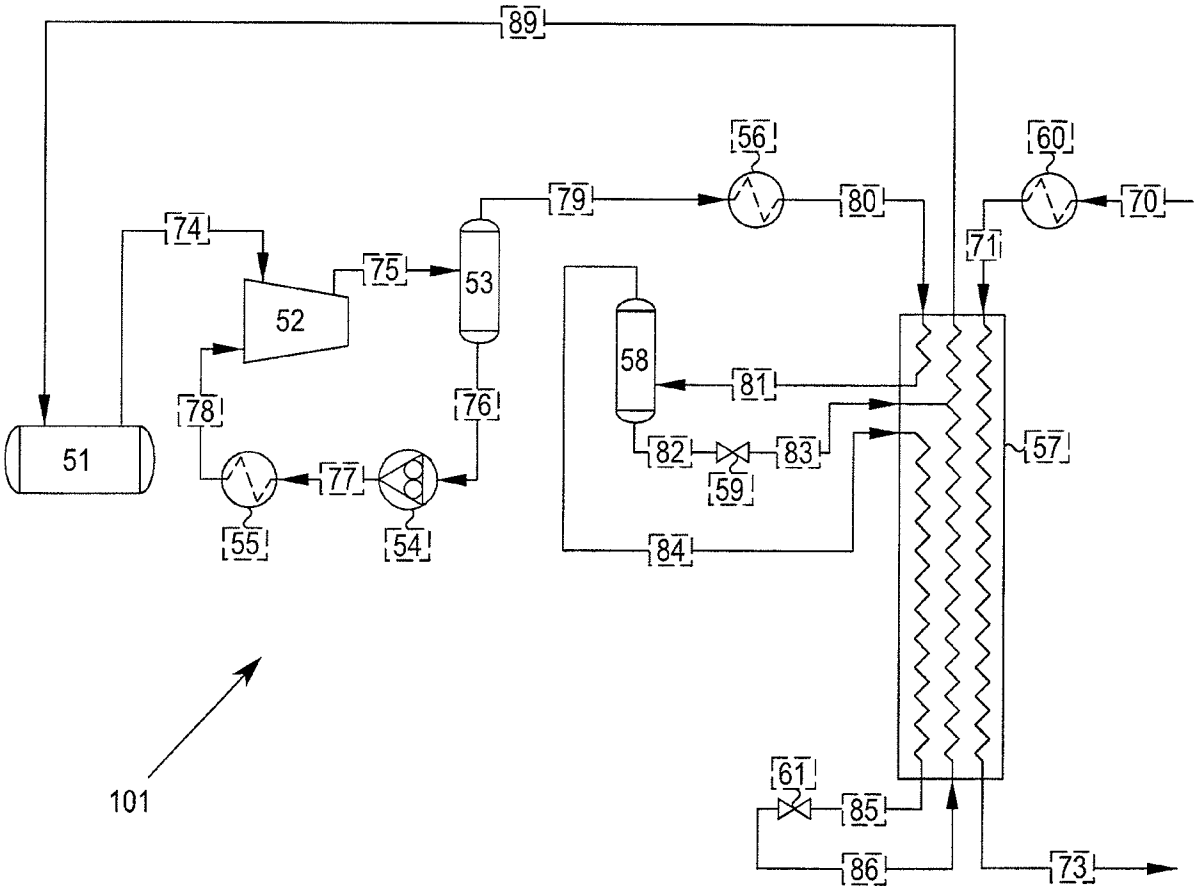
FIG. 3 is a schematic view of a method of cooling a BOG stream using an SMR system according to a first embodiment of the present invention.

FIG. 3 shows a more-detailed SMR recirculating system 101 being a first variation example of the SMR recirculating system 200 shown in FIG. 2. The first SMR recirculating system 101 comprises a single multi-stream liquefaction heat exchanger 57, (typically a brazed aluminium plate-fin heat exchanger), where the cooled (and compressed) BOG stream 71 is condensed by the colder streams discussed herein before in the SMR recirculating system 200.

Figure 4:
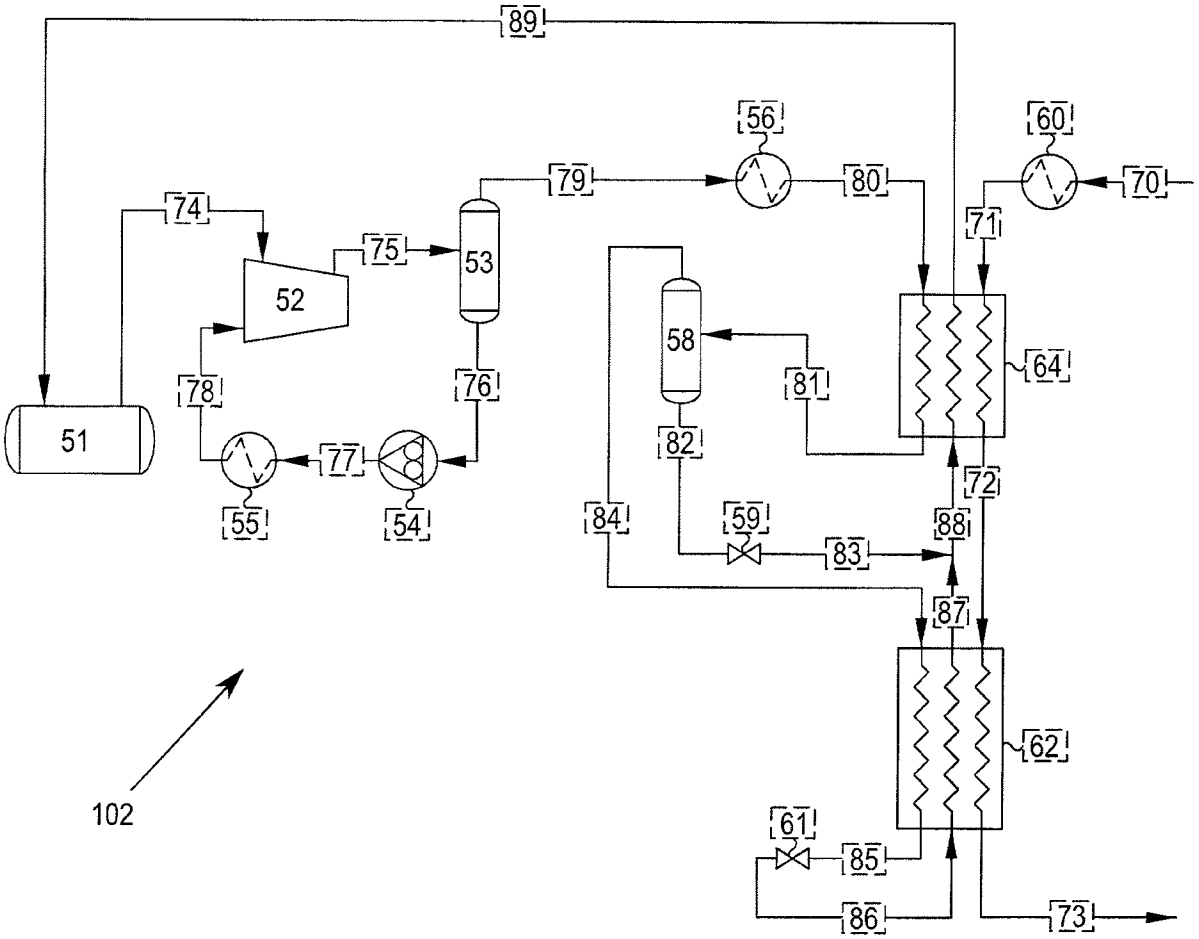
FIG. 4 is a schematic view of a method of cooling a BOG stream using an SMR system according to a second embodiment of the present invention.

FIG. 4 shows a second variation example SMR recirculating system 102 of the SMR recirculating system 200 shown in FIG. 2, wherein the liquefaction heat exchanger system now comprises two heat exchangers, being the first and second multi-stream heat exchange units 64 and 62. In FIG. 4, there is a mixing of cold streams externally of the heat exchange units 64 and 62. That is, the expanded lowest-temperature SMR stream or coldest refrigerant stream 86 is sent into the second unit 62, where it starts to vaporise as it heats up, and in doing so, cools the warmer streams in the second unit 62, and then exits as a part-warmer SMR stream 87 prior to merging with the expanded liquid-phase SMR stream 83 to form a combined stream 88, which then passes into the first unit 64 to cool the warmer streams in the first unit 64, and leaving the first unit 64 as a post-cooling vapour stream 89, to be returned to refrigerant receiver 51. Meanwhile, the cooled BOG from the first unit 64 passes as stream 72 into the second cooler unit 62.

The first and second heat exchange units 64 and 62 may be contiguous or separate.

Figure 5:
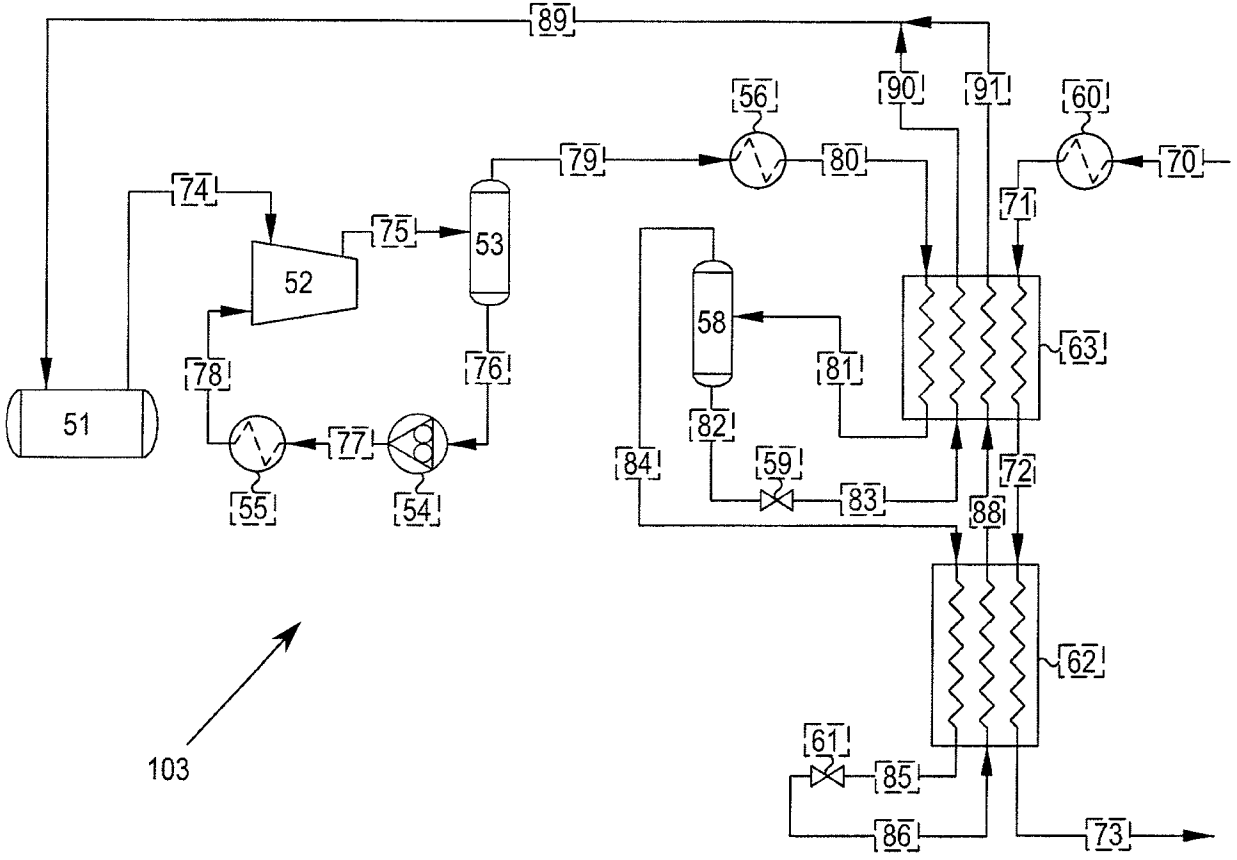
FIG. 5 is a schematic view of a method of cooling a BOG stream using an SMR system according to a third embodiment of the present invention.

FIG. 5 shows a third variation example SMR recirculating system 103, being a further variation of the SMR recirculating system 102 shown in FIG. 4. In FIG. 5, the liquefaction heat exchanger system comprises first and second multi-stream heat exchange units 63 and 62. Compared with FIG. 4, the expanded liquid-phase SMR stream 83 and part-warmer SMR stream 88 are kept separate in first unit 63. The first and second warmer SMR streams 90 and 91 provided by the liquefaction heat exchanger system are combined in the vapour phase after they leave the first unit 63 to form a combined post-cooling vapour stream 89, to be returned to refrigerant receiver 51.

Figure 6:
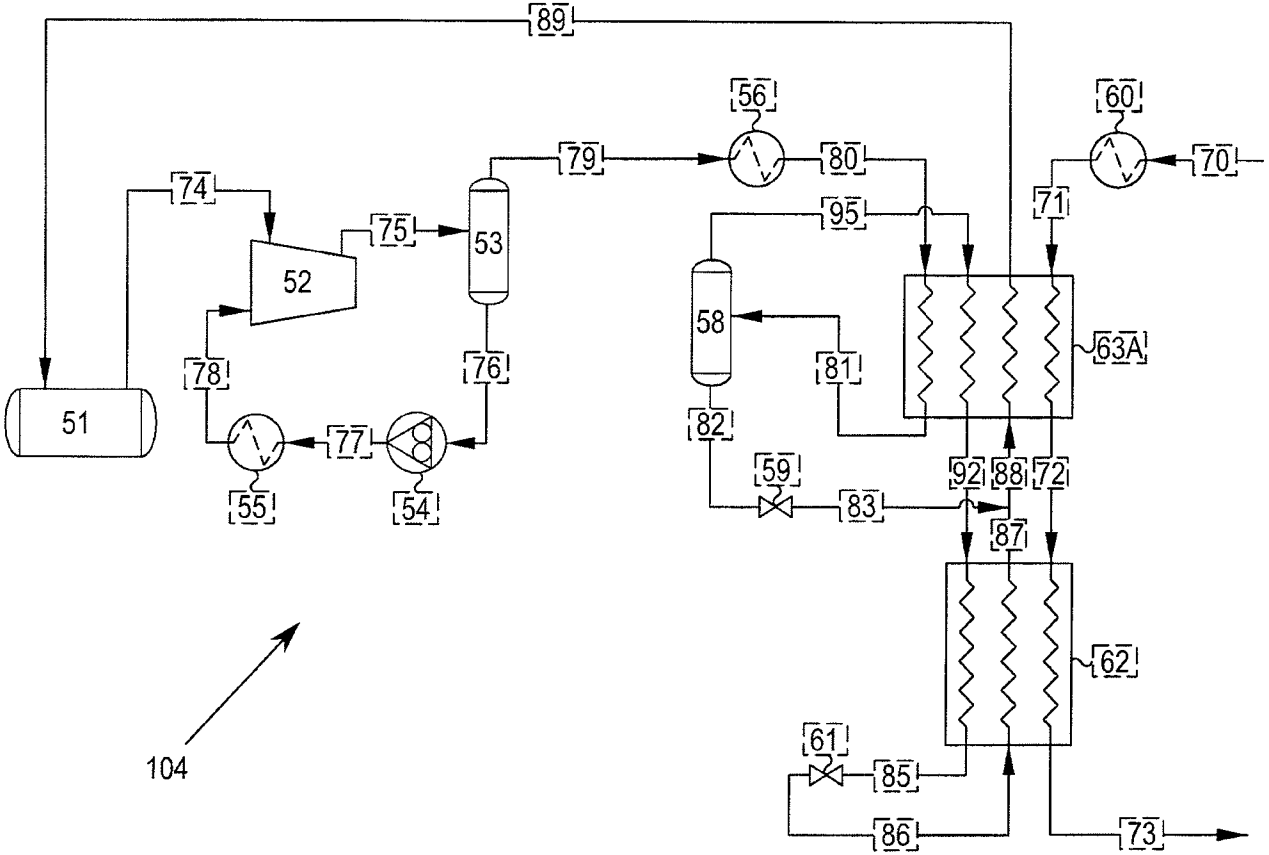
FIG. 6 is a schematic view of a method of cooling a BOG stream using an SMR system according to a fourth embodiment of the present invention.

FIG. 6 shows a fourth variation example SMR recirculating system 104, being another variation of the SMR recirculating system 102 shown in FIG. 4. In FIG. 6, the liquefaction heat exchanger system comprises first and second multi-stream heat exchange units 63A and 62. Compared with FIG. 4, the oil-free SMR vapour stream 95 provided by the vapour-liquid separator 58 now passes into the warmer first unit 63A to provide an intermediate stream 92, prior to passage through the cooler second unit 62 (to exit as a condensed SMR stream 85).

Figure 7:
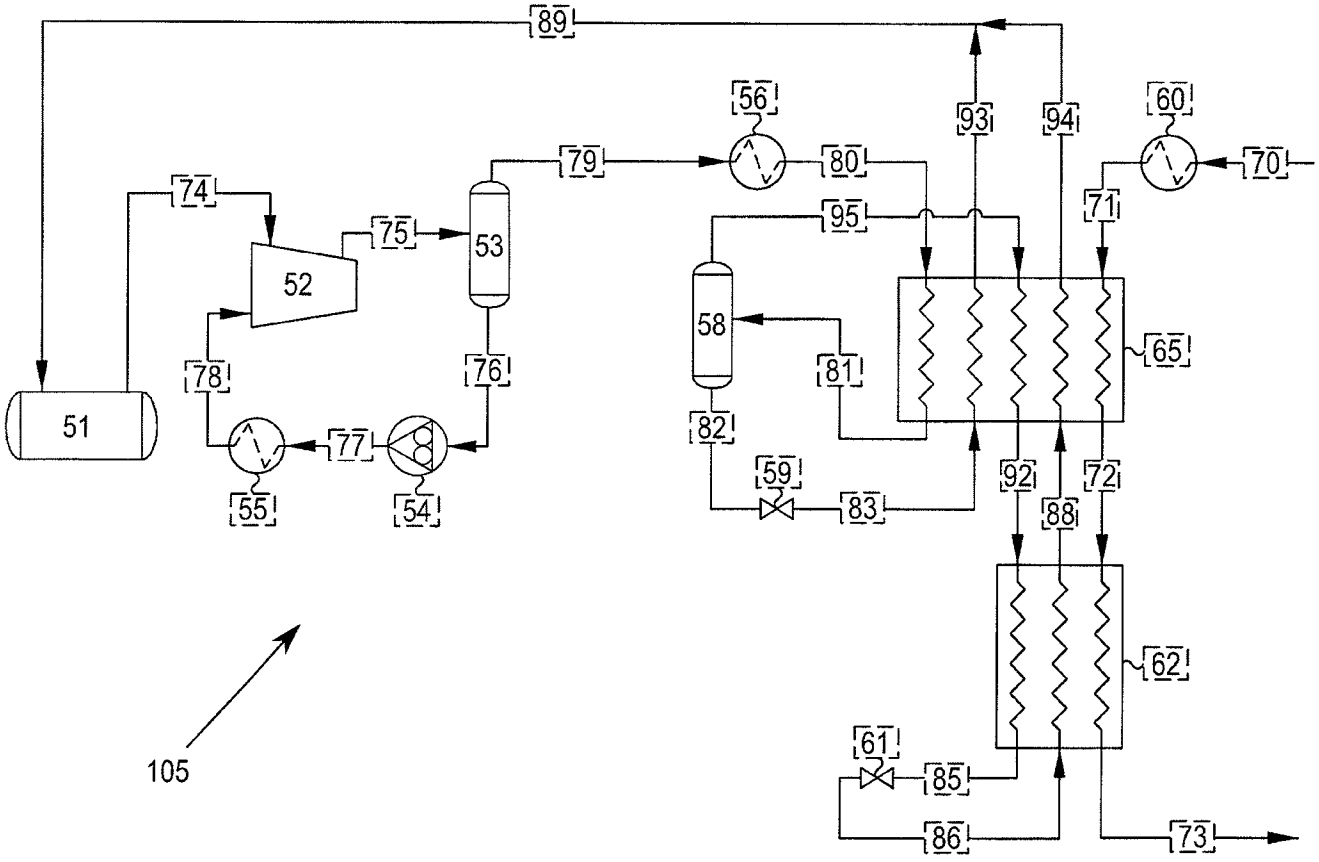
FIG. 7 is a schematic view of a method of cooling a BOG stream using an SMR system according to a fifth embodiment of the present invention.

FIG. 7 shows a fifth variation example SMR recirculating system 105, being a combination of the third SMR recirculating system 103 shown in FIG. 5 and the fourth SMR recirculating system 104 shown in FIG. 6. In FIG. 7, the liquefaction heat exchanger system comprises first and second multi-stream heat exchange units 65 and 62, and the oil-free SMR vapour stream 95 provided by the vapour-liquid separator 58 now passes into the first warmer unit 65 (to provide an intermediate stream 92, prior to passage through the second cooler unit 62 to exit as a condensed SMR stream 85), and the expanded liquid-phase SMR stream 83 and part-warmer SMR stream 88 are kept separate in first unit 65. The first and second warmer SMR streams 93 and 94 provided by the liquefaction heat exchanger system are combined in the vapour phase after they leave the first unit 65 to form a combined post-cooling vapour stream 89, to be returned to refrigerant receiver 51.

FIG. 8 shows a sixth variation example SMR recirculating system 106, being a combination of the first SMR recirculating system 101 shown in FIG. 3 and the fourth SMR recirculating system 104 shown in FIG. 6. In FIG. 8, the liquefaction heat exchanger system comprises a single multi-stream liquefaction heat exchanger 66, and the oil-free SMR vapour stream 95 provided by the vapour-liquid separator 58 now passes fully through the heat exchanger 66 (to provide a condensed SMR stream 85), whilst the expanded liquid-phase SMR stream 83 merges with the refrigerant stream 86 at an intermediate location within the heat exchanger 66 to form a single stream which leaves the heat exchanger 66 as a post-cooling vapour stream 89, to be returned to refrigerant receiver 51.

FIG. 9 shows a seventh SMR variation example recirculation system 107, being a variant of the SMR recirculating system 104 shown in FIG. 6, wherein the first multi-stream heat exchange unit 63A in the liquefaction heat exchanger system is replaced by a series of two-stream heat exchangers. The series of two-stream heat exchangers still provide the same first and warmer stage or section of the liquefaction heat exchanger system, now using a series of distinct heat exchangers suitably arranged to work together.

In FIG. 9, the cooler first vapour stream 80 passes into a first two-stream heat exchanger 96 against a stream discussed hereinafter, to provide the cooled first SMR vapour stream 81 in the same manner as before, to pass into the vapour-liquid separator 58. From the separator 58, a liquid-phase SMR stream 82 is expanded by a flash valve 59 to provide an at least partly vaporised, liquid-phase SMR stream 83.

The separator 58 also provides the oil-free SMR vapour stream 95, which passes into a second two-stream heat exchanger 97 to provide an intermediate stream 92 prior to its passage into the same second unit 62 as discussed and shown in FIG. 6.

Meanwhile, the cooled and compressed BOG stream 71 passes into a third two-stream heat exchanger 98 to provide a cooler BOG stream 72 to pass into the second cooler unit 62.

The second unit 62 in FIG. 9 provides the condensed BOG stream 73 in the same manner as described above, and a part-warmer SMR stream 87, which merges with the expanded liquid-phase SMR stream 83 to form a combined stream 88, which is then divided into part-streams 99A and 99B. Part-stream 99A passes into the second heat exchanger 97, and part-stream 99B passes into the third heat exchanger 98. Their exit streams combine to form a combined stream 100 which then passes into the first heat exchanger 96 to exit as the post-cooling vapour stream 89.

Where the liquefaction heat exchanger system comprises multiple heat exchanger units, the present invention is not limited by the relative positioning of the first and second units, which may be contiguous or separate.

It is possible that the composition and/or ratio of components in the SMR can be varied to achieve best effect for each arrangement of the present invention. It is also possible that the SMR composition is different in each of the examples shown in FIGS. 3-9.

The present invention is a modification of a typical single mixed refrigerant (SMR) cycle for LNG re-liquefaction in particular, that allows the use of a cost-efficient oil-injected screw compressor in the mixed refrigerant system. In comparison with the typical arrangement, the present innovation allows for reduced complexity, fewer pieces of equipment, and reduced capital cost.

The invention claimed is:

1. A method of cooling a boil-off gas (BOG) stream from a liquefied gas tank using a single mixed refrigerant (SMR) comprising the steps of:

heat exchanging the BOG stream with the SMR in a liquefaction heat exchanger system to provide a cooled BOG stream, wherein the SMR is provided in an SMR recirculating system comprising the steps of (a) compressing the SMR using at least one oil-injected screw compressor to provide a post-compression SMR stream;

(b) separating the post-compression SMR stream to provide an oil-based stream and a first SMR vapour stream;

(c) (1) passing the first SMR vapour stream into the liquefaction heat exchanger system to cool the first SMR vapour stream and provide a cooled first SMR vapour stream; and (2) passing the oil-based stream into an oil cooler and reinjecting the oil-based stream back into the screw compressor;

(d) withdrawing the cooled first SMR vapour stream from an intermediate position of the liquefaction heat exchanger system;

(e) separating the cooled first SMR vapour stream to provide a liquid-phase SMR stream comprising liquid and residual oil and a second SMR vapour stream;

passing the second SMR vapour stream through the liquefaction heat exchanger system to provide a condensed SMR stream;

(g) expanding the condensed SMR stream to provide an expanded lowest-temperature SMR stream having a temperature below the oil-solidification temperature of the oil in the at least one oil-injected screw compressor and passing the expanded lowest-temperature SMR stream through the liquefaction heat exchanger system as a main cooling stream for heat exchange against the BOG stream;

(h) expanding the liquid-phase SMR stream of step (e) prior to passing the liquid-phase SMR into the liquefaction heat exchanger system, and passing the expanded liquid-phase SMR stream into the liquefaction heat exchanger system adjacent the intermediate position for withdrawing the cooled first SMR vapour stream of step (d); and combining the expanded liquid-phase SMR stream with the expanded lowest-temperature SMR stream within the liquefaction heat exchanger system adjacent the intermediate position of steps (d) and (h).

2. The method as claimed in claim 1 wherein the BOG stream is from one of the following: a liquefied cargo tank in a floating vessel, or a liquefied natural gas (LNG) cargo tank.

3. The method as claimed in claim 1 wherein the liquefaction heat exchanger system comprises a single liquefaction heat exchanger.

4. The method as claimed in claim 3 comprising in step (f) passing the second SMR vapour stream fully through the single liquefaction heat exchanger.

5. The method as claimed in claim 1 further comprising the steps of passing the first SMR vapour stream into a first heat exchange unit, and passing the second SMR vapour stream into both a first heat exchange unit and a second heat exchange unit.

6. The method as claimed in claim 1 wherein the multi-unit liquefaction heat exchange comprising two multi-stream heat exchangers.

7. The method as claimed in claim 1 wherein the multi-unit liquefaction heat exchange comprising one multi-stream heat exchanger and a plurality of two-stream heat exchangers.

8. The method as claimed in claim 1 further comprising the step of ambient-cooling the first SMR vapour stream prior to step (c).

9. The method as claimed in claim 1 wherein step (i) provides a post-cooling vapour SMR stream for recirculation and reuse as part of the SMR recirculating system.

10. The method as claimed in claim 1 wherein the first SMR vapour stream of step (b) does not undergo any external refrigerant cooling prior to step (e).

11. The method as claimed in claim 1 wherein the BOG stream does not undergo any external refrigerant cooling prior to passing through the liquefaction heat exchanger.

12. The method as claimed in claim 1 wherein the liquefaction heat exchanger system comprises one or more plate-fin heat exchangers.

13. The method as claimed in claim 1 wherein the expanded lowest-temperature SMR stream provides the cooling of the first SMR vapour stream.

14. An SMR recirculating system for use with a method of cooling a boil-off gas (BOG) stream from a liquefied gas tank using a single mixed refrigerant (SMR) comprising the steps of heat exchanging the BOG stream with the SMR in a liquefaction heat exchanger system to provide a cooled BOG stream, wherein the SMR is provided in an SMR recirculating system comprising the steps of (a) compressing the SMR received from a refrigerant receiver using at least one oil-injected screw compressor to provide a post-compression SMR stream;

(b) separating the post-compression SMR stream to provide an oil-based stream and a first SMR vapour stream;

(c) passing the first SMR vapour stream into the liquefaction heat exchanger system to cool the first SMR vapour stream and provide a cooled first SMR vapour stream;

(d) withdrawing the cooled first SMR vapour stream from an intermediate position of the liquefaction heat exchanger system;

(e) separating the cooled first SMR vapour stream to provide a liquid-phase SMR stream comprising liquid and residual oil and a second SMR vapour stream;

(f) passing the second SMR vapour stream through the liquefaction heat exchanger system to provide a condensed SMR stream;

(g) expanding the condensed SMR stream to provide an expanded lowest-temperature SMR stream having a temperature below the oil-solidification temperature of the oil in the at least one oil-injected screw compressor and passing the expanded lowest-temperature SMR stream through the liquefaction heat exchanger system as a main cooling stream for heat exchange against the BOG stream, and (h) expanding the liquid-phase SMR stream of step (e) prior to passing the liquid-phase SMR into the liquefaction heat exchanger system, and passing the expanded liquid-phase SMR stream into the liquefaction heat exchanger system adjacent the intermediate position for withdrawing the cooled first SMR vapour stream of step (d);

(i) merging the expanded liquid-phase SMR stream with the expanded lowest-temperature SMR stream within the liquefaction heat exchanger system adjacent the intermediate position of steps (d) and (h);

(j) discharging the merged stream from the liquefaction heat exchanger system to form a post cooling vapour stream; and (k) recycling the post cooling vapour stream to the refrigerant receiver of step (a) to form the SMR.

15. An SMR recirculating system as claimed in claim 14 for use in cooling the BOG stream from one of the following: a liquefied gas cargo tank in a floating vessel, or a liquefied natural gas (LNG) cargo tank.

16. The SMR recirculating system as claimed in claim 14 further comprising providing a sub-ambient refrigerant cooling duty for cooling the boil-off gas stream from a liquefied gas tank.

17. An apparatus for cooling a boil-off gas (BOG) stream from a liquefied gas tank comprising a single mixed refrigerant (SMR) recirculating system as defined in claim 14 and a liquefaction heat exchanger system for heat exchange against the BOG stream.

18. A method of cooling a boil-off gas (BOG) stream from a liquefied gas tank using a single mixed refrigerant (SMR) comprising the steps of:

heat exchanging the BOG stream with the SMR in a liquefaction heat exchanger system to provide a cooled BOG stream, wherein the SMR is provided in an SMR recirculating system comprising the steps of (a) compressing the SMR using at least one oil-injected screw compressor to provide a post-compression SMR stream;

(b) separating the post-compression SMR stream to provide an oil-based stream and a first SMR vapour stream;

(c) passing the first SMR vapour stream into the liquefaction heat exchanger system to cool the first SMR vapour stream and provide a cooled first SMR vapour stream;

(d) withdrawing the cooled first SMR vapour stream at an intermediate position from the liquefaction heat exchanger system;

(e) separating the cooled first SMR vapour stream to provide a liquid-phase SMR stream comprising liquid and residual oil and a second SMR vapour stream;

(f) passing the second SMR vapour stream through the liquefaction heat exchanger system to provide a condensed SMR stream;

(g) expanding the condensed SMR stream to provide an expanded lowest-temperature SMR stream, the expanded lowest-temperature SMR stream having a temperature below the oil-solidification temperature of the oil in the at least one oil-injected screw compressor;

(h) passing the expanded lowest-temperature SMR stream through the liquefaction heat exchanger system, the expanded lowest-temperature SMR stream acting as a main cooling stream within the heat exchanger system and providing the main cooling duty for heat exchange against the BOG stream;

(i) expanding the liquid-phase SMR stream of step (e) prior to passing the liquid-phase SMR into the liquefaction heat exchanger system, and passing the expanded liquid-phase SMR stream into the liquefaction heat exchanger system adjacent the intermediate position for withdrawing the cooled first SMR vapour stream of step (d);

(j) merging the expanded liquid-phase SMR stream and the expanded lowest-temperature SMR stream inside of the heat exchanger system adjacent the intermediate position of steps (d) and (i) to form a single stream that leaves the heat exchanger system as a single post cooling vapour stream; and (k) recycling the single post cooling vapour stream to a refrigerant receiver of to form the SMR of step (a).

19. The SMR recirculating system as claimed in claim 14 further comprising passing the oil-based stream of step (b) into an oil cooler and reinjecting the oil-based stream back into the screw compressor.

20. The method as claimed in claim 18 further comprising the step of passing the oil-based stream of step (b) into an oil cooler and reinjecting the oil-based stream back into the screw compressor.

* * * * *